US005819941A

United States Patent [19]

Vanwingerden

[11] Patent Number: 5,819,941

[45] Date of Patent: Oct. 13, 1998

[54] PLANT PALLET

[76] Inventor: Leonard Vanwingerden, 216 Stafford Rd., Somers, Conn. 06071

[21] Appl. No.: 844,470

[22] Filed: Apr. 18, 1997

Related U.S. Application Data

[60] Provisional application No. 60/015,841, Apr. 18, 1996.

[51] Int. Cl.[6] ..... B65D 75/00

[52] U.S. Cl. ..... 206/511; 206/423

[58] Field of Search ..... 206/511, 505, 206/512, 423; 211/126

[56] References Cited

U.S. PATENT DOCUMENTS

| | | | |
|---|---|---|---|
| 2,630,924 | 3/1953 | Vacanti | 206/511 |
| 2,632,567 | 3/1953 | Richtmyer | 206/511 |
| 2,774,511 | 12/1956 | Menkin et al. . | |
| 3,180,288 | 4/1965 | McCowan | 206/511 |
| 3,294,040 | 12/1966 | Gregoire . | |
| 3,481,507 | 12/1969 | Sanders . | |
| 4,441,615 | 4/1984 | Goodrich | 206/511 |
| 5,035,326 | 7/1991 | Stahl | 206/511 |
| 5,060,819 | 10/1991 | Apps | 206/511 |
| 5,341,748 | 8/1994 | Liu . | |

FOREIGN PATENT DOCUMENTS

| | | |
|---|---|---|
| 2661155 | 4/1990 | France . |
| 0649622 | 6/1977 | Russian Federation . |

*Primary Examiner*—Joseph M. Moy

*Attorney, Agent, or Firm*—Donald S. Holland, Esq.; Holland & Bonzagni, P.C.

[57] ABSTRACT

A pallet is disclosed for housing plants during their growth, transport and display. In the preferred embodiment, the pallet has a generally rectangular central deck; four sides or rims that border that deck; and two rows of complementary W-shaped legs along opposite sides. The unique structures of these leg rows allow for: secure nesting of multiple pallets when empty; secure stacking of multiple pallets during transportation; and stacking in multiple configuration for display on store floors. Not only are the displays quick to assemble, they also provide easy access for maintenance of the housed plants by employees (e.g., watering), plus inspection and removal of the plants by perspective customers.

8 Claims, 8 Drawing Sheets

PLANT PALLET

BACKGROUND OF THE INVENTION

This "regular" patent application is based upon a "provisional" patent application, entitled "PLANT PALLET," Application Ser. No. 60/015841, filed Apr. 18, 1996 by the same inventor.

This invention relates, in general, to containers that stack within each other, or nest. More particularly, it relates to pallets for the transport of plants from growing facilities to the marketplace.

Wholesale growers, or greenhouses, typically nurture seedlings at one location, then move the young plants onto pallets for shipping. Those pallets are basically trays. The filled pallets are then slid into wheeled containers, which space the pallets apart, much like bread racks.

Upon their arrival at a store, the containers (with their pallets) are unloaded. Eventually, the plants are removed from the pallets; and, for display, they are individually placed directly on the store floor or in multi-tiered stands. Or, the plants stay on the pallets, which may be stacked using concrete blocks. All these displays occupy valuable floor space; and they are tedious to set up.

Occasionally, pallets are stacked using removable pegs. As with the concrete-block displays, or even ready-made display stands, set-up is labor intensive.

It would be extremely beneficial if a system of pallets could be developed for the growth, transport and display of plants. Such pallets should be able to stack during usage, and nest together when empty. Ideally, such pallets should allow for growth and maintenance of seedlings, as they are stored within the pallets; multiple pallets should be stackable together for transporting the seedlings, without injury to the plants; and the stacked pallets should be able to be displayed attractively, directly on the store floor, with a minimum amount of set-up. Further, the store display should also permit easy maintenance of the plants, plus their inspection and/or removal by perspective customers.

There are plenty of nesting containers, but none that achieve these desired results. For example, U.S. Pat. No. 3481507 to Sanders discloses containers that nest and stack. However, Sanders'containers lack the structure needed for displaying plants - namely, a sizable space between stacked, aligned containers that permits growth and easy access, for maintenance of the plants (e.g., watering) or removal by customers.

Accordingly, it is a primary object of the present invention to provide a plant pallet that overcomes the deficiencies of the prior art.

It is another general object of the present invention to provide a system of pallets that stack during usage, for the growth, maintenance, transport and display of plants.

It is yet another object to provide a system of plant pallets, commensurate with the above listed objects, which permits various configurations for store displays, including an alternating, multi-tiered arrangement.

The above and other objects and advantages of this invention will become more readily apparent when the following detailed descriptions are read in conjunction with the accompanying drawings.

SUMMARY OF THE INVENTION

A plant pallet is disclosed for growing, transporting and displaying plants. In the preferred embodiment, a pallet has two rows of generally W-shaped legs or supports. These legs, located on opposite pallet sides, have either locking pegs or corresponding recesses at the various apexes. The legs permit nesting of the pallets, when unused, but also allow for stacking them apart during transport or display.

DETAILED DESCRIPTION OF THE PREFERRED EMBODIMENT

Figure 1:
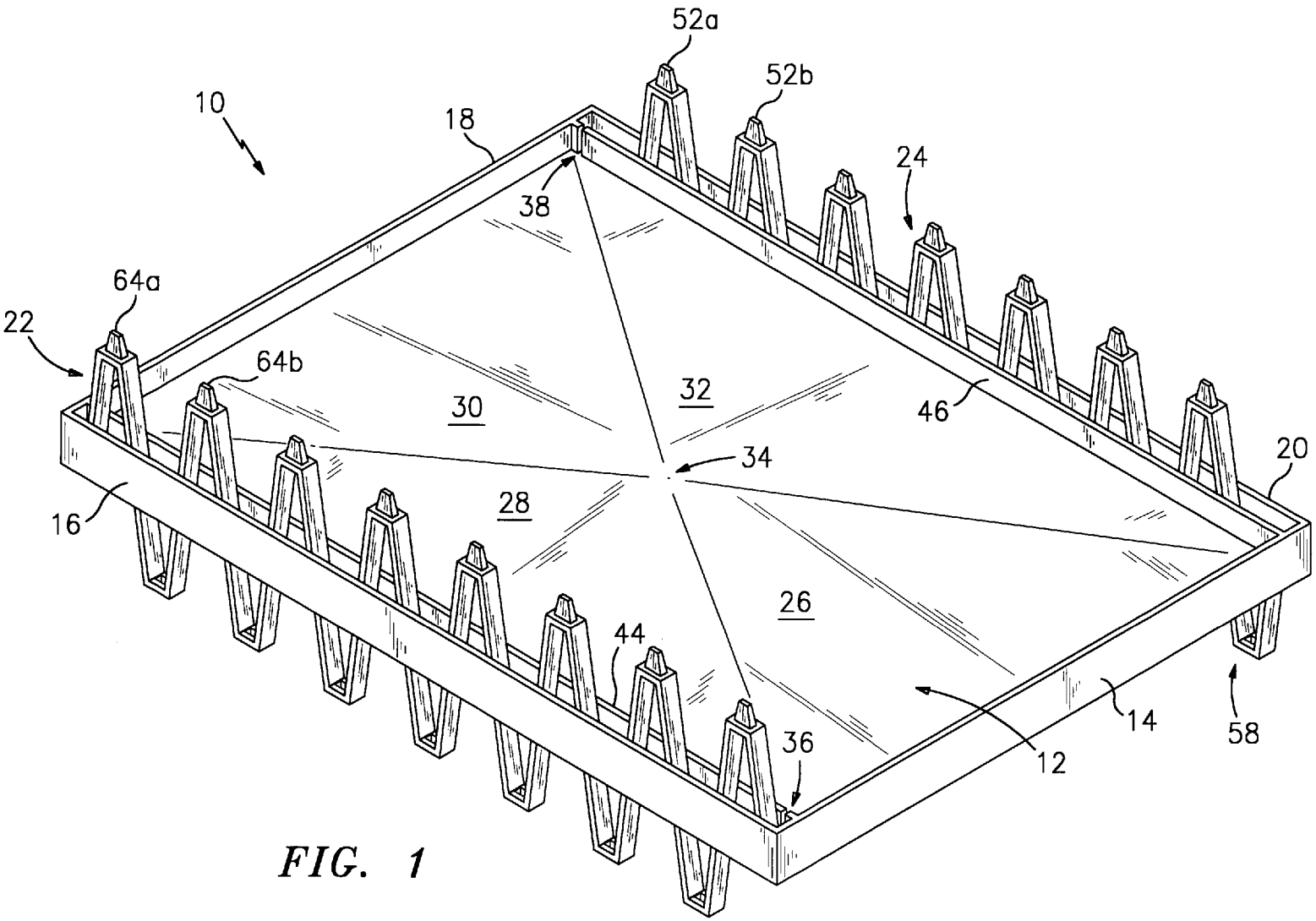
FIG. 1 shows a plant pallet constructed in accordance with the present invention, nicknamed the VW™ plant pallet.
Figure 2:
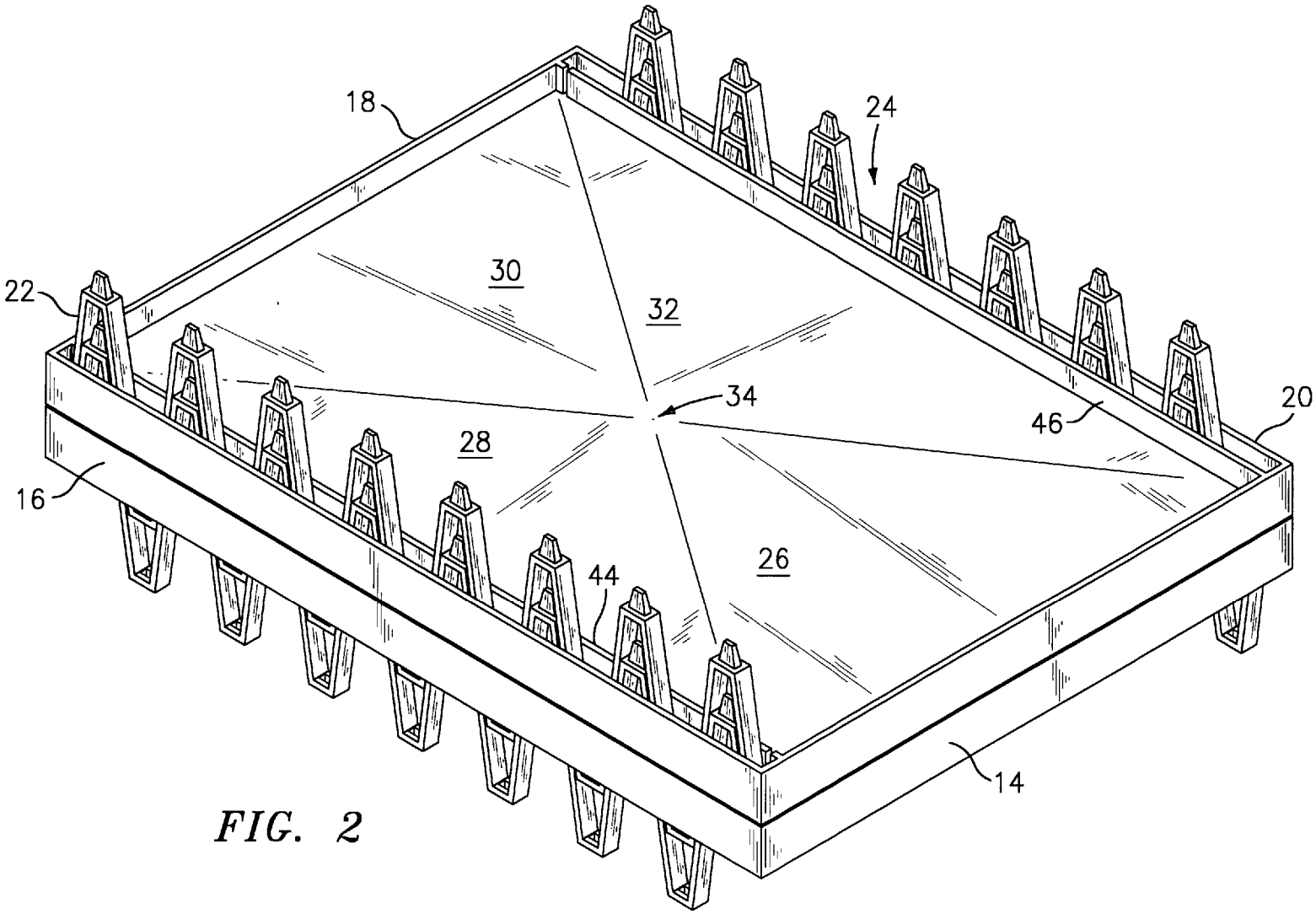
FIG. 2 shows multiple VW™ pallets in a "nesting" arrangement.

Referring to the drawings in detail, a plant pallet is shown and generally designated by the reference numeral 10. It is marketed under the trademark VW™ by Grower Direct Farms, Inc. of Somers, Conn.

As best shown in FIGS. 1–8, each of the preferred VW™ pallets 10 has a generally rectangular central deck 12; four sides or rims 14, 16, 18, 20 that border the deck 12; and two chains or rows 22, 24 of generally W-shaped legs, along opposite sides 16, 20, that allow multiple pallets 10 to stack during usage, and nest when empty.

Figure 11:
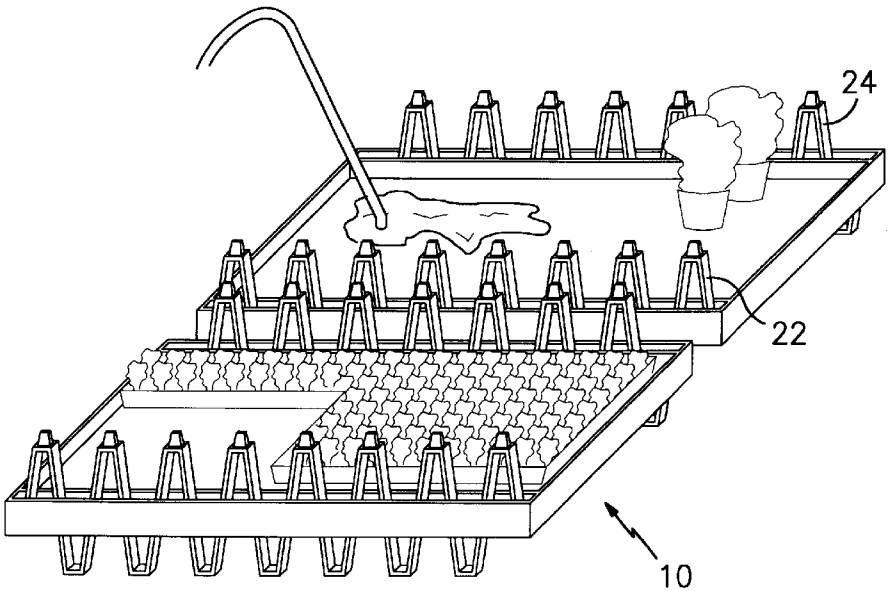
FIG. 11 shows single VW™ pallets resting on the ground, with plants in them, during watering.
Figure 10:
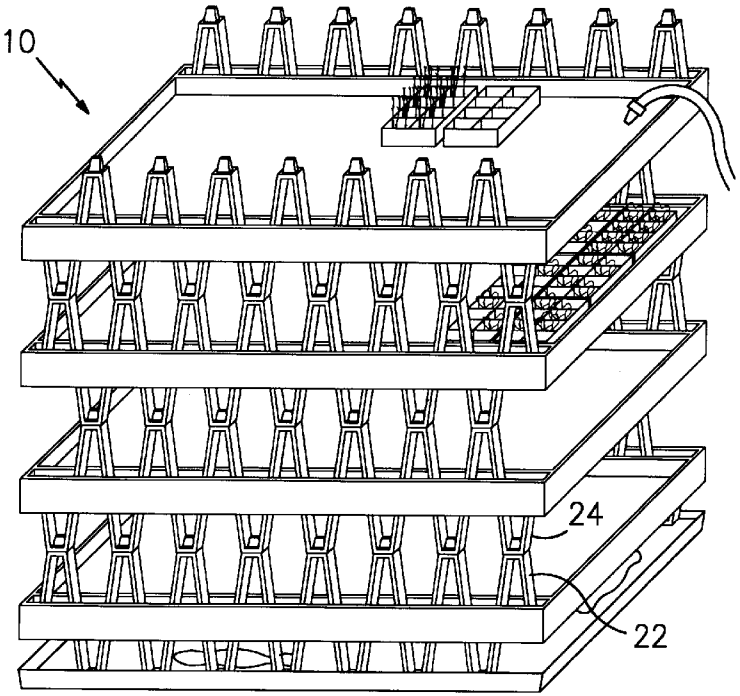
FIG. 10 shows multiple VW™ pallets stacked, with plants in them, and an optional watering pan to catch the water from a hose also illustrated.

FIGS. 1,4, 4*a*, 5, and 5*a* best depict the structure of deck 12. The deck 12 has four gently sloped, "triangular" sections 26, 28, 30, 32 that meet at an apex 34, much like a short pyramid. This apex is preferably ¼ inch higher than the deck's perimeter. Holes 36, 38 in two corners of the deck 12 (see FIG. 4*a*) cooperate with the sloped deck portions 26, 28, 30, 32 to allow watering (see FIGS. 10 and 11) and automatic drainage.

Sidewalls or rims 14, 16, 18,20 are substantially perpendicular to the perimeter of deck 12. They also extend both above and below the deck (see FIG. 5). Opposing sidewalls 16 and 20 also are parallel to the rows 22, 24 of W-shaped legs.

Each row (22 or 24) of the W-shaped legs is attached and contained between a sidewall (16 or 20) and a reinforcing inner wall (44 or 46). Each inner wall 44, 46 provides support for its respective chain 22, 24 of W-shaped legs and prevents twisting during stacking.

Figure 6:
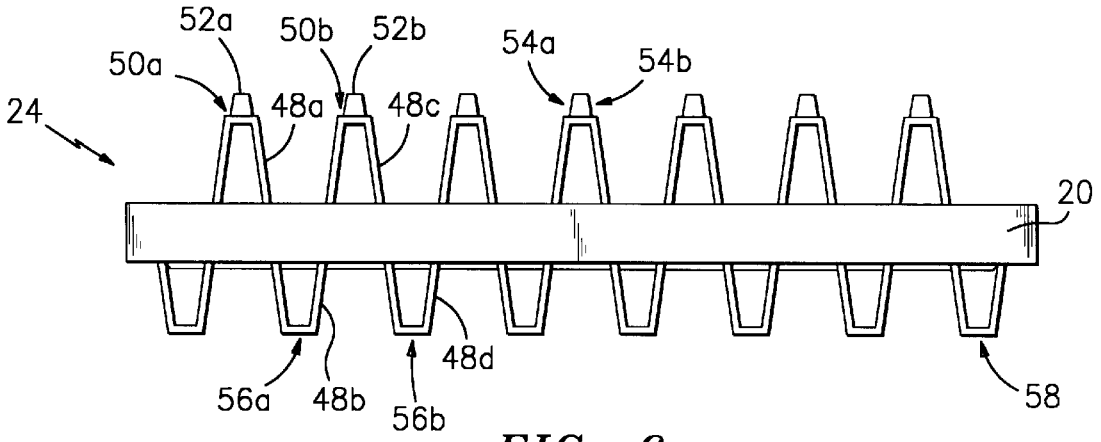
FIG. 6 shows an elevational view of the right-hand side of the FIG. 4 pallet.

FIG. 6 depicts row 24 of W-shaped legs. That row, for a point of reference, is the righthand row shown in FIG. 1.

Figure 5:
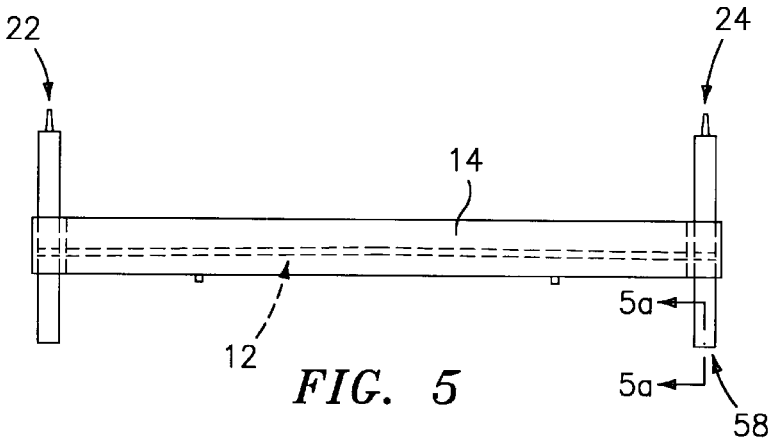
FIG. 5 shows an end elevational view of the FIG. 4 pallet.
Figure 5A:
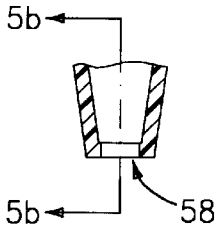
FIG. 5*a* shows a cross-sectional view of a VW™ "nesting"/"stacking", taken along line 5*a* —5*a* of FIG. 5, with portions broken away.
Figure 5B:
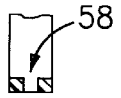
FIG. 5*b* shows another cross-sectional view of the leg, taken along line 5*b* —5*b* of FIG. 5*a*.

Row 24 is formed of a series of laterally spaced bars (e.g., 48*a*, 48*b*, 48*c*, 48*d*) successively inclined in opposite directions and connected end-to-end to provide the alternate "V" and inverted "V" form shown. Preferably, the bars are integrally connected (for strength) to one another and together form the letter "W". The upper ends of the bars provide flat horizontal surfaces or saddles (e.g., 50*a*, 50*b*). Each saddle has an integral upwardly extending locking lug or projection (e.g., 52*a*, 52*b*) formed with dovetail sides (e.g., 54*a*, 54*b* ) which diverge in an inward direction relative to deck 12. The lower connected ends of the bars (e.g., 48*a*, 48*b*, 48*c*, 48*d*) have flat horizontal surfaces or feet (e.g., 56*a*, 56*b* ). Each foot is formed with a locking slot or recess, with one such recess being shown at 58 in FIGS. 5*a*, 5*b*. This recess is shaped to snugly receive a locking lug.

Figure 4:
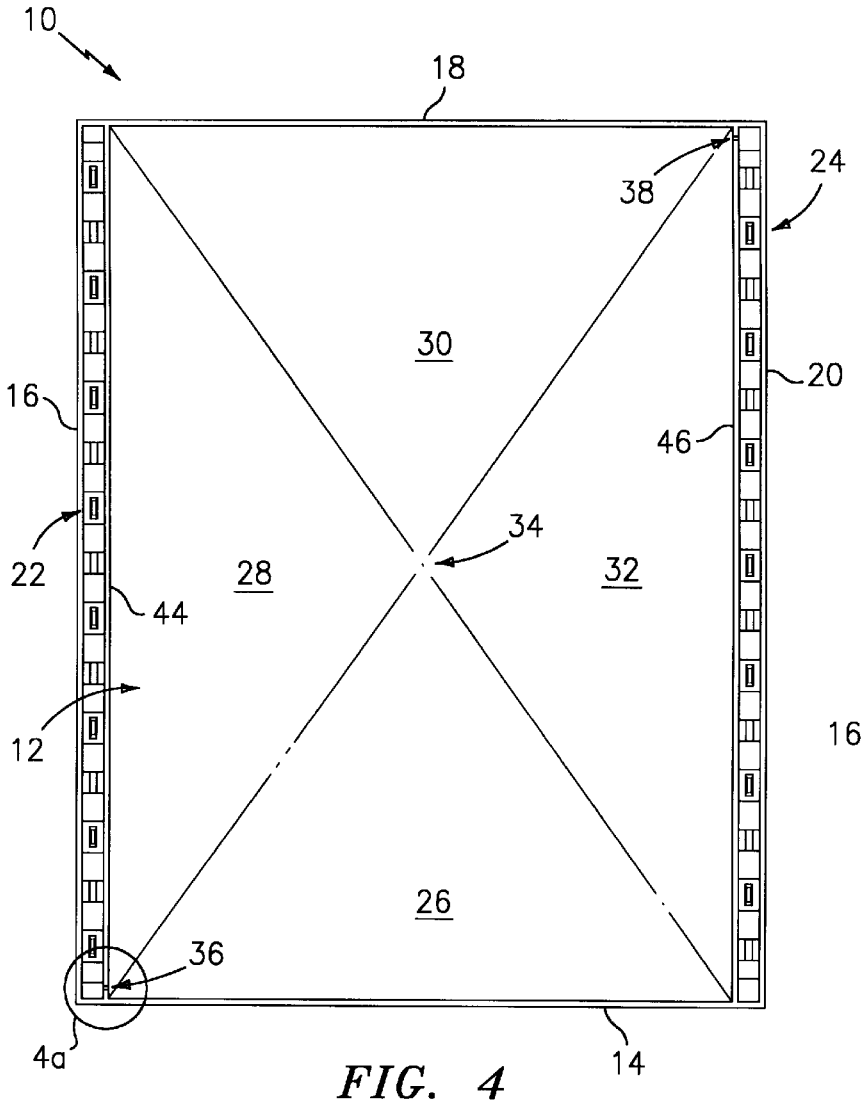
FIG. 4 shows a top plan view of VW™ pallet.
Figure 4A:
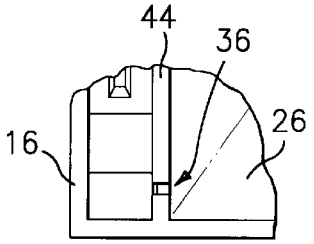
FIG. 4*a* shows an enlarged view of an encircled corner of the FIG. 4 pallet, depicting a drain hole.

As indicated above, the inner mid-lengths of the bars (e.g., 48*a*, 48*b*, 48*c*, 48*d*) are permanently secured to the outer surface of the sidewall 14 (see FIG. 4). The outer mid-lengths of the bars are likewise secured to the inner surface of the reinforcing wall 46 (see FIG. 4).

Figure 7:
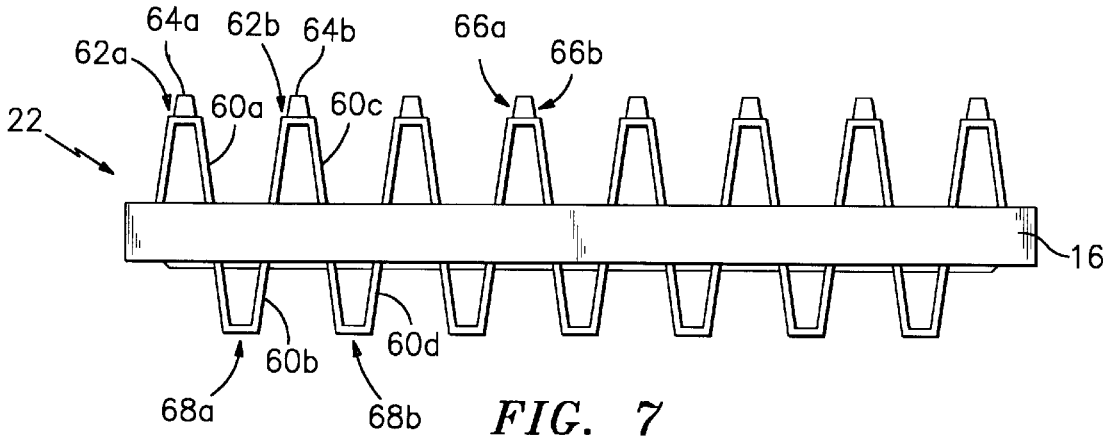
FIG. 7 shows an elevational view of the opposite or left-hand side of the FIG. 4 pallet.
Figure 8:
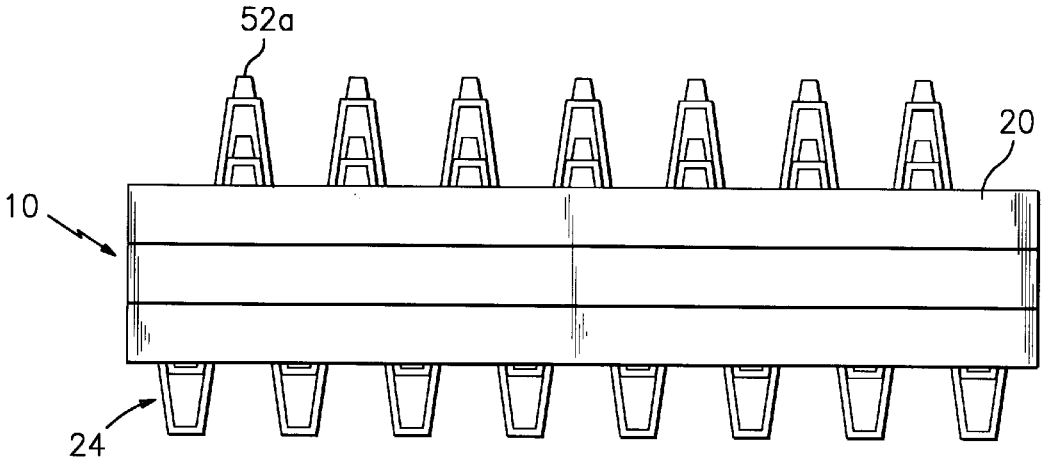
FIG. 8 shows a side elevational view of three VW™ pallets "nested" together.

FIG. 7 depicts the opposite row 22 of W-shaped legs. This row is extremely similar to the row 24 previously described.

Leg row 22 is also formed of a series of laterally spaced bars (e.g., 60*a*, 60*b*, 60*c*, 60*d*) successively inclined in the opposite direction and connected end-to-end to provide an alternate "V" and inverted "V" form. In the preferred embodiment, these are integrally connected at their ends and together form an upside-down "W" or the letter "M". The upper connected ends of the bars provide flat horizontal surfaces or saddles (e.g., 62*a*, 62*b*). Each saddle has an upwardly extending locking projection or lug (e.g., 64*a*, 64*b*) formed with dovetail sides (e.g., 66*a*, 66*b*). The lower ends of the bars have flat horizontal surfaces or feet (e.g., 68*a*, 68*b* ). The middle of each foot has a locking recess or slot (not shown) adapted to receive a locking projection.

As with leg row 24, row 22 is integrally connected (along the mid-lengths of its inclined bars) to sidewall 16 and inner wall 44. It should be noted that, since the pallet 10 is preferably made of plastic, the integral attachment would be part of the standard molding process.

All of the saddles (e.g., 50*a*, 50*b* and 62*a*, 62*b* ) are disposed in a common horizontal plane above the pallet sides 14, 16, 18, 20. All of the feet (e.g., 56*a*, 56*b* and 66*a*, 66*b*) are disposed in a common horizontal plane below the sides 14, 16, 18, 20. All of the locking projections or lugs (e.g., 52*a*, 52*b*, 64*a*, 64*b* ) are of identical form and all of the locking recesses (e.g., 58) are adapted in form to receive the locking projections.

In euphemistic terms, each row 22, 24 resembles a sinusoidal curve, with the peaks and valleys occurring at multiples of 90°. Moving from left to right in FIGS. 7 and 6, the sinusoidal curve for row 22 starts at 0°, while the curve for row 24 starts at 180°.

The structures of leg rows 22, 24 allow for: secure nesting of empty pallets (see FIGS. 2 and 8); growth and maintenance of plants within pallets (see FIG. 11); secure stacking during transportation (see FIGS. 3 and 9*a* –9*d* ); movement of individual and stacks of pallets by forklift 68 or pallet jack 70 (see FIGS. 9*a*, 9*b*, 9*c*, 9*d*); and stacking in an alternating multi-tiered arrangement (see FIG. 12) on store floors.

With regard to stacking of empty pallets (see FIG. 2), this is accomplished by lowering a pallet onto a similarly aligned lower pallet. In both instances, the pallets 10 are oriented in the same manner as shown in FIG. 1.

Figure 3:
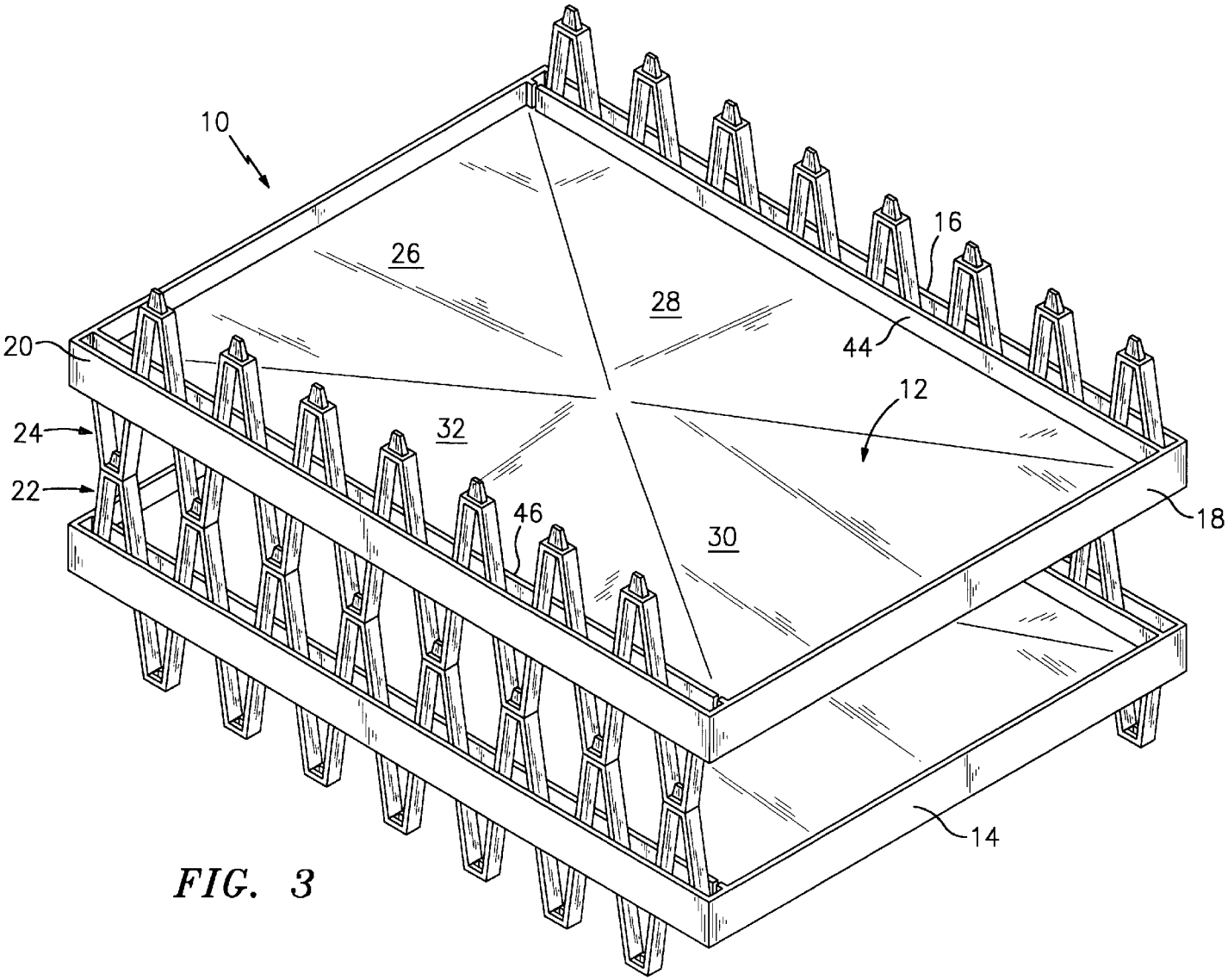
FIG. 3 shows the FIG. 2 pallets in a "stacked" arrangement, with the top pallet having been rotated 180° from its FIG. 2 position.
Figure 12:
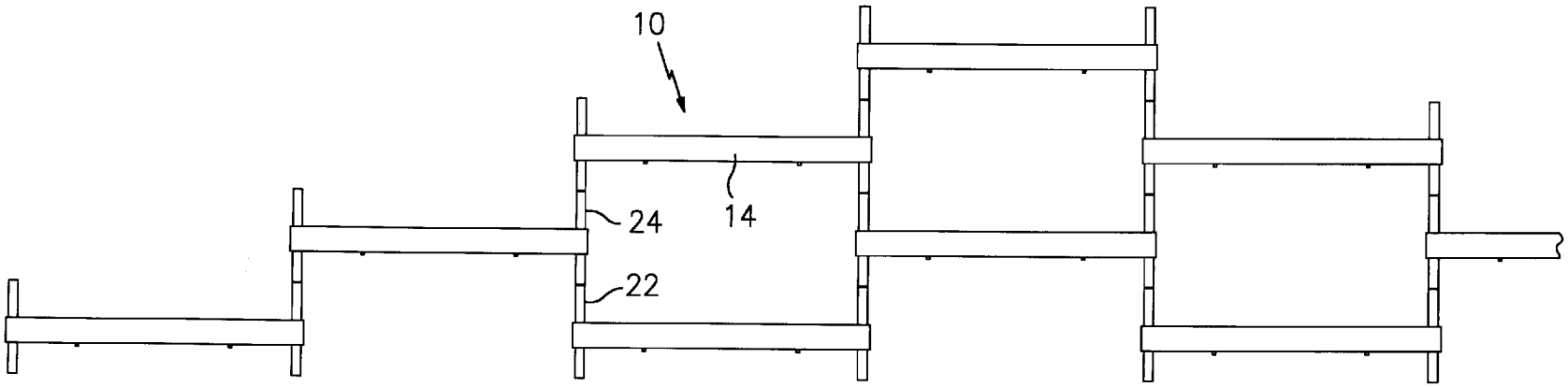
FIG. 12 shows a front elevational view of multiple VW™ pallets stacked in an alternating tiered arrangement for display (and easy maintenance) of housed plants in the marketplace.

For store displays, there are optional stacking methods, as depicted in FIGS. 3 and 12. Referring to the simplified stacking approach in FIG. 3, that is achieved by first placing a pallet 10 on the ground in the orientation shown in FIG. 1. Next, another pallet 10 is rotated 180°, so that the left-hand and right-hand rows 22, 24 assume each other's original position. Upon lowering the rotated pallet 10 upon the "grounded" one, the "W(s)" and "M(s)" of rows 22, 24 mate and stack in the position shown in FIG. 3.

Figure 9A:
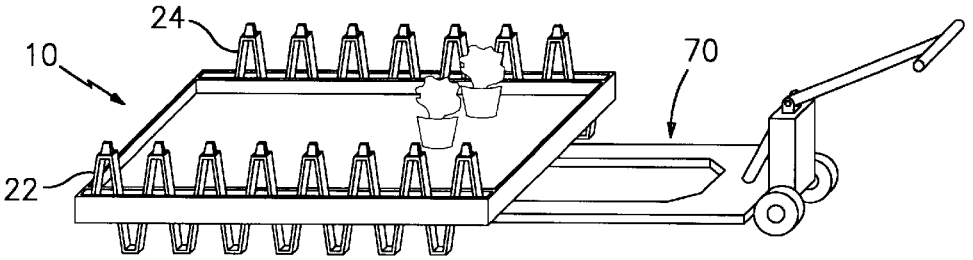
FIG. 9*a*, 9*b*, 9*c* and 9*d* show VW™ pallets during transport.
Figure 9B:
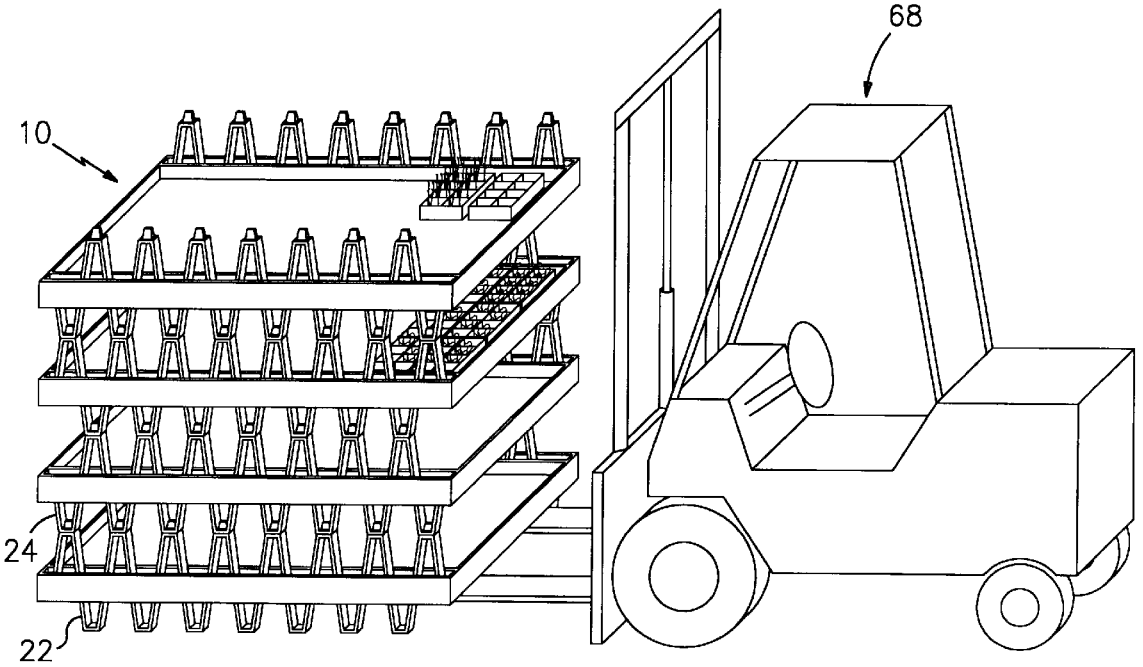
Figure 9C:
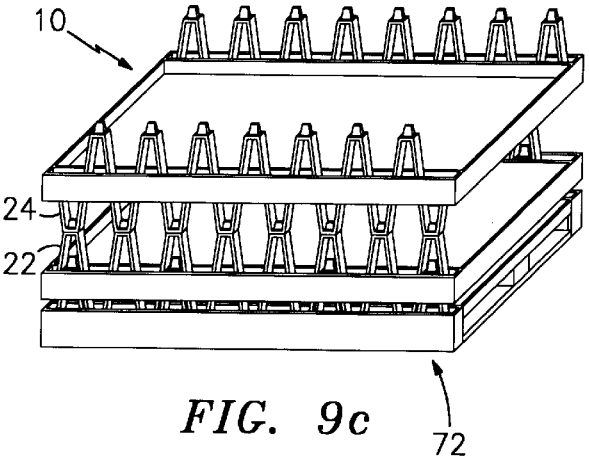

During transportation, the simplified stacking of FIGS. 3 and 9*b* is used. There is no need for any external container, like the bread rack mentioned in the "BACKGROUND OF THE INVENTION."

Figure 9D:
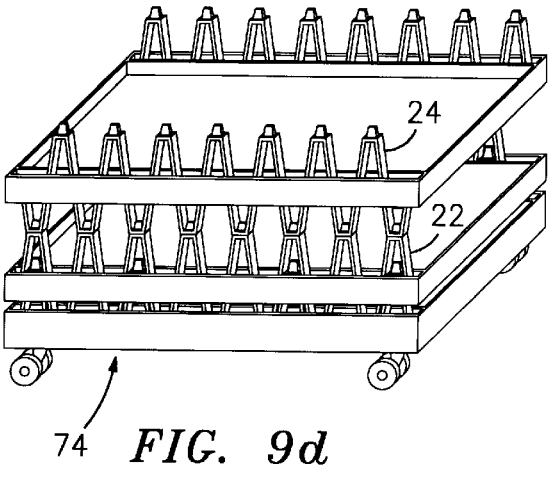

Movement of stacked pallets 10 can be assisted by modified versions of a standard pallet base 70 (see FIG. 9*c*) and dolly 72 (see FIG. 9*d*). Both the pallet base 72 and dolly 74 have inverted "V" legs attached to them that fit within similarly shaped portions of rows 22, 24. This secures the stacks to these optional bases.

FIG. 12 depicts the alternating multi-tiered arrangement that may be preferred by store owners for display. To achieve this stacking, there is no need to rotate the pallets 10. Instead, the pallets are all aligned in the same orientation. For example, each pallet's row 22 is on the left-hand side of the pallet in the FIG. 12 display, and row 24 is on the pallet's right-hand side. Instead of directly placing an overlying row (22, 24) onto an identical row of an underlying pallet, a "different" row (24, 22) of another pallet (alongside) is used as a spacer. This doubles the gap or spacing between the standard stacks shown in FIG. 3. This increased spacing has several advantages: it permits easy maintenance and unrestricted growth of seedlings on store floors; it provides an attractive display; and it provides easy access for inspection or removal of the plants by customers.

Unlike the nesting container of U.S. Pat. No. 3481507 to Sanders, described in the "BACKGROUND OF THE INVENTION", the structure of pallets 10 permits a gap (of two different sizes) between stacked pallets 10. This spacing permits access to plants that cannot be achieved by Sander's patented containers. Primarily, that is because the W-shaped legs of pallet 10 extends above and below the pallet's sides.

It should be noted by those skilled in the art that all these structural modifications can be made without departing from the spirit and scope of the invention. For example, the rows of W-shaped legs may not be continuous chains. Also, the size of the legs and pallets can be varied, or the legs relocated. Accordingly, reference should be made primarily to the accompanying claims, rather than the foregoing specification, to determine the scope of the invention.

What is claimed is:

1. A system of plant pallets for the growth, transport and display of plants housed within the pallets, wherein each of said pallets comprising:

a. a central deck for supporting plants;

b. four sidewalls rimming the deck, wherein the sidewalls extend both above and below the deck;

c. nesting-and-stacking means for nesting multiple empty pallets and for stacking multiple pallets with gaps between the pallets that allow for growth of the plants within the gaps and provide access to the decks of the stacked pallets, through the gaps, for watering the plants, plus for visual inspection and removal of the plants, wherein the nesting-and-stacking means comprises:

(i) two parallel rows of complementary W-shaped legs attached to opposing sidewalls;

(ii) at least a plurality of the W-shaped legs extends both above and below the sidewalls and deck; and (iii) each of the W-shaped legs has top horizontal saddles with locking lugs extending upwardly from the saddles and each of the W-shaped legs has feet with recesses adapted in shape to receive a locking lug during stacking.

2. The plant pallet of claim 1 wherein each row of W-shaped legs comprises a chain of oppositely inclined bars that from multiple W-shaped units that are linked together.

3. The plant pallet of claim 1 wherein each row of W-shaped lug is contained within an open channel formed by a sidewall and a parallel reinforcing inner wall.

4. The plant pallet of claim 1 wherein the deck is comprised of multiple sloped sections that rise toward one another.

5. A system of plant pallets for the growth, transport and display of plants housed within the pallets, wherein each of said pallets comprising:

a. a central substantially rectangular deck for supporting plants;

b. four sidewalls integral with and bordering the deck, wherein the sidewalls are substantially perpendicular to the deck and extend both above and below the deck;

c. nesting-and-stacking means for nesting multiple empty pallets and for stacking multiple pallets with gaps between the pallets that allow for growth of the plants within the gaps and provide access to the decks of the stacked pallets, through the gaps, for watering the plants, plus for visual inspection and removal of the plants, wherein the nesting-and-stacking means comprises:

(i) two parallel rows of complementary W-shaped legs attached to opposing sidewalls;

(ii) each row of W-shaped legs comprises a chain of oppositely inclined bars that form multiple W-shaped units that are linked together; and (iii) each of the W-shaped units has top horizontal saddles with locking lugs extending upwardly from the saddles and each of the W-shaped units has bottom feet with recesses adapted in shape to receive a locking lug during stacking.

6. The plant pallet of claim 5 wherein each row of W-shaped lug is contained within an open channel formed by a sidewall and a parallel reinforcing inner wall.

7. The plant pallet of claim 6 wherein the deck is comprised of four triangular sections that rise toward a center of the deck and meet an apex.

8. The plant pallet of claim 7 wherein there are drain holes through the deck that are adjacent to sidewalls.

* * * * *

UNITED STATES PATENT AND TRADEMARK OFFICE

CERTIFICATE OF CORRECTION

PATENT NO. : 5,819,941

DATED : October 13, 1998

INVENTOR(S) : Leonard VanWingerden

It is certified that error appears in the above-identified patent and that said Letters Patent is hereby corrected as shown below:

On the title page, under item [19] and item [76], change "Vanwingerden" to --VanWingerden--.

Signed and Sealed this

Sixteenth Day of February, 1999

*Attest:*

*Attesting Officer*

*Acting Commissioner of Patents and Trademarks*